US006476697B2

(12) United States Patent
Swartzentruber et al.

(10) Patent No.: US 6,476,697 B2
(45) Date of Patent: Nov. 5, 2002

(54) MODULAR MULTI-PHASE CONTACTOR

(75) Inventors: Brent James Swartzentruber, Carpinteria; Daniel C. Sullivan, Santa Barbara; Lyhn Phung, Ventura; Eric Glenn Hufstedler; James Clayton Reed, both of Santa Barbara; Marcus Priest, Carpinteria; Bernard Victor Bush; Michael Henry Molyneux, both of Santa Barbara, all of CA (US)

(73) Assignee: Kilovac Corporation, Carpinteria, CA (US)

( * ) Notice: Subject to any disclaimer, the term of this patent is extended or adjusted under 35 U.S.C. 154(b) by 0 days.

(21) Appl. No.: 09/764,944

(22) Filed: Jan. 18, 2001

(65) Prior Publication Data

US 2002/0050877 A1 May 2, 2002

Related U.S. Application Data

(60) Provisional application No. 60/176,682, filed on Jan. 18, 2000.

(51) Int. Cl.[7] ..... H01H 67/02

(52) U.S. Cl. ..... 335/132; 335/202

(58) Field of Search ..... 335/8–10, 132, 335/202, 167–176; 200/293–312

(56) References Cited

U.S. PATENT DOCUMENTS

| | | | | |
|---|---|---|---|---|
| 2,692,926 A | | 10/1954 | Cole | |
| 3,069,517 A | * | 12/1962 | Cole | 335/8 |
| 3,193,646 A | | 7/1965 | Krebs et al. | |
| 3,453,569 A | | 7/1969 | Ostby | |
| 3,626,338 A | | 12/1971 | Nicol et al. | |
| 3,786,380 A | | 1/1974 | Harper | |
| 3,806,849 A | | 4/1974 | Hughes | |
| 4,042,894 A | | 8/1977 | Coleman | |
| 4,066,989 A | | 1/1978 | Krueger | |
| 4,114,122 A | | 9/1978 | Grenier | |
| 4,166,988 A | | 9/1979 | Ciarcia et al. | |
| 4,281,305 A | * | 7/1981 | Weeks | 335/132 |
| 4,347,488 A | * | 8/1982 | Mune et al. | 335/9 |
| 4,647,886 A | | 3/1987 | Schmiedel et al. | |
| 4,899,120 A | | 2/1990 | Ohtake et al. | |
| 5,200,725 A | | 4/1993 | Arnold et al. | |
| 5,233,321 A | | 8/1993 | Blanchard et al. | |
| 5,298,874 A | | 3/1994 | Morel et al. | |
| 5,557,082 A | | 9/1996 | Leet et al. | |
| 5,680,083 A | | 10/1997 | Kogawa et al. | |
| 5,844,457 A | | 12/1998 | Eckroth et al. | |
| 5,867,079 A | | 2/1999 | Duchemin et al. | |
| 5,886,602 A | | 3/1999 | Burel et al. | |
| 5,910,757 A | | 6/1999 | Broghammer et al. | |

* cited by examiner

*Primary Examiner*—Lincoln Donovan
*Assistant Examiner*—Tuyen T. Nguyen
(74) *Attorney, Agent, or Firm*—Christie, Parker & Hale, LLP

(57) ABSTRACT

A modular, multi-phase electrical relay contactor assembled from a number of electrical relay contactor units. Each unit has a housing, an electromagnetic motor located within the housing, a pair of stationary contacts attached to the housing, a moveable contact, and a moveable contact carrier. The moveable contact carrier is engaged with the moveable contact and has a metallic clapper plunger attached to its upper end. A protrusion extends from one side of the moveable contact carrier and an aperture, sized to receive the protrusion of another electrical relay contactor unit, is formed through another side of the moveable contact carrier. A plurality of units are adapted to be connected together such that when engaged, the protrusion extending from the moveable contact carrier of a forwardly located unit will fit into the aperture formed in the moveable contact carrier of a rearwardly located unit, thereby providing synchronous movement of the plurality of moveable contact carriers and the moveable contacts.

18 Claims, 10 Drawing Sheets

FIG. 13
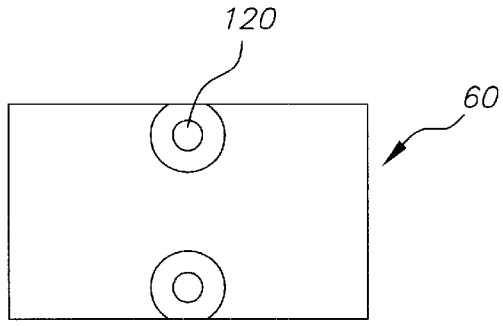
FIG. 14
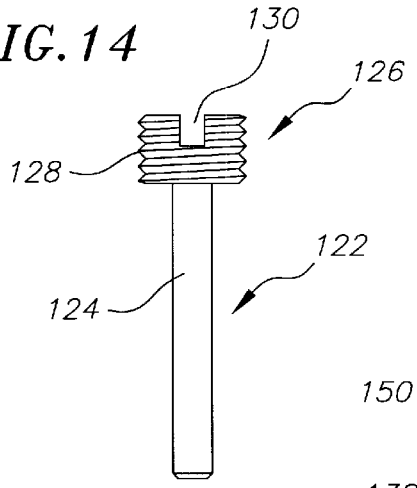
FIG 16
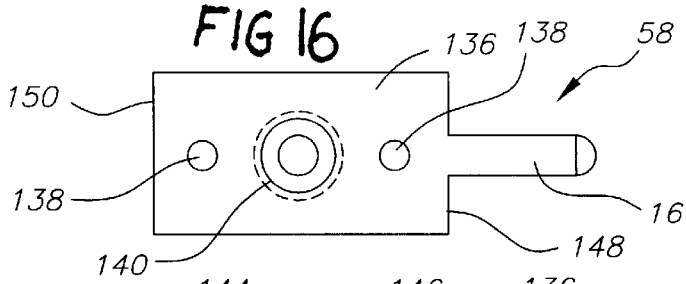
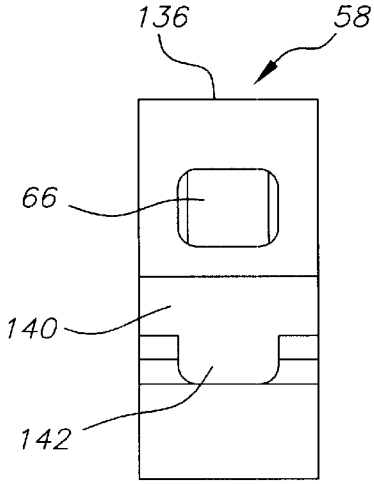
FIG. 17
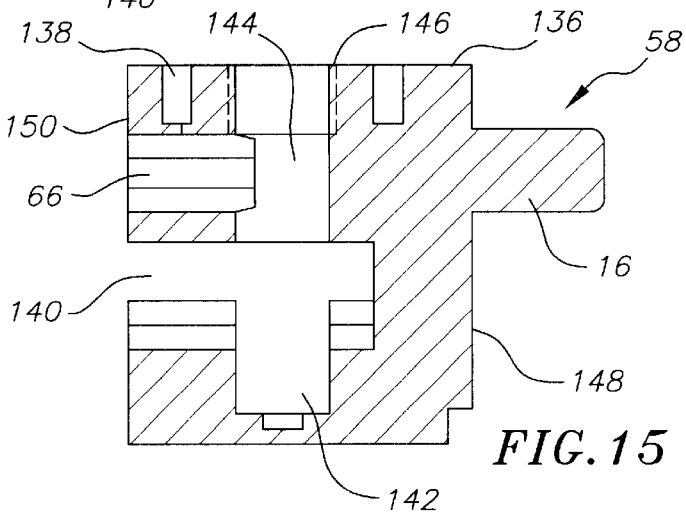
FIG. 15

MODULAR MULTI-PHASE CONTACTOR

CROSS REFERENCE TO RELATED APPLICATIONS

The present application claims the benefit of U.S. provisional patent application No. 60/176,682 entitled "MODULAR MULTI-PHASE CONTACTOR," filed Jan. 18, 2000, the contents of which are hereby incorporated by reference.

BACKGROUND OF THE INVENTION (Field Of Invention)

The invention relates generally to the field of electrical relays, and more particularly to a modular multi-phase electrical relay contactor having a reduced number of and lower cost parts and increased reliability.

BACKGROUND OF THE INVENTION (Description of the Prior Art)

Electrical relays are used in a wide variety of applications, including automotive, aircraft, and industrial applications, and are used for power switching applications. All electrical relays permit a relatively small voltage source to actuate a gate for larger voltage/currents.

Electrical relays, particularly high voltage electrical relays, have tended to be relatively expensive. The relatively high expense relates to deficiencies in the available designs, which include the need for relatively expensive materials, and a comparatively large number of complex parts which must be separately manufactured and assembled.

In cases where multi-phase relay switching (e.g. three phase) is required, in the past, unitary structures have been provided. Unfortunately, unitary multi-phase relay and not always versatile and their likely smaller production runs can be more costly to produce. For example, if a particular application requires simultaneous switching of more than three lines, either a plurality of multiple relays must be connected together and carefully controlled, or a custom built relay must be assembled. To the extent that making small runs of customized unitary relays can be avoided, it would be preferably to gang together individual modules.

There accordingly remains a need for a new design for an electrical relay contactor, which has fewer parts, that is made of less expensive materials, and that can be more easily and quickly assembled.

SUMMARY OF THE INVENTION

One object of the invention is to provide a new design for a modular electrical relay contactor that is easily and quickly assembled from relatively few parts.

Another object of the invention is to provide a new design for a modular electrical relay contactor that is made from relatively low cost components, and in which modular units can be ganged together to provide for multi-phase switching.

A further object of the invention is to provide a modular electrical relay contactor that is reliable over a wide variety of conditions, and which assures synchronous switching between the plurality of modules.

These and other objects of the invention are achieved by providing a new design of modular single pole, double throw electrical relay contactor in which a moveable contactor is carried by a modular receptacle designed with the receptacle of an adjacent electrical relay contactor.

To provide for lower material and assembly costs, a small number of non-conducting and metallic units can be quickly screwed and/or slipped together. This feature simplifies assembly, reduces costs, and improves quality.

DESCRIPTION OF THE DRAWINGS

FIG. 13 is a top view of the clapper plunger of the single modular electrical relay contactor shown in FIG. 4.

FIG. 14 is a side view of the moveable retainer guide pin of the single modular electrical relay contactor shown in FIG. 4.

FIG. 15 is a cross-sectional side view of the moveable contact carrier of the single modular electrical relay contactor shown in FIG. 4, but with the moveable contact removed.

FIG. 16 is a top view of the moveable contact carrier of FIG. 16.

FIG. 17 is a front view of the moveable contact carrier of FIG. 15.

DETAILED DESCRIPTION OF THE INVENTION

Figure 1:
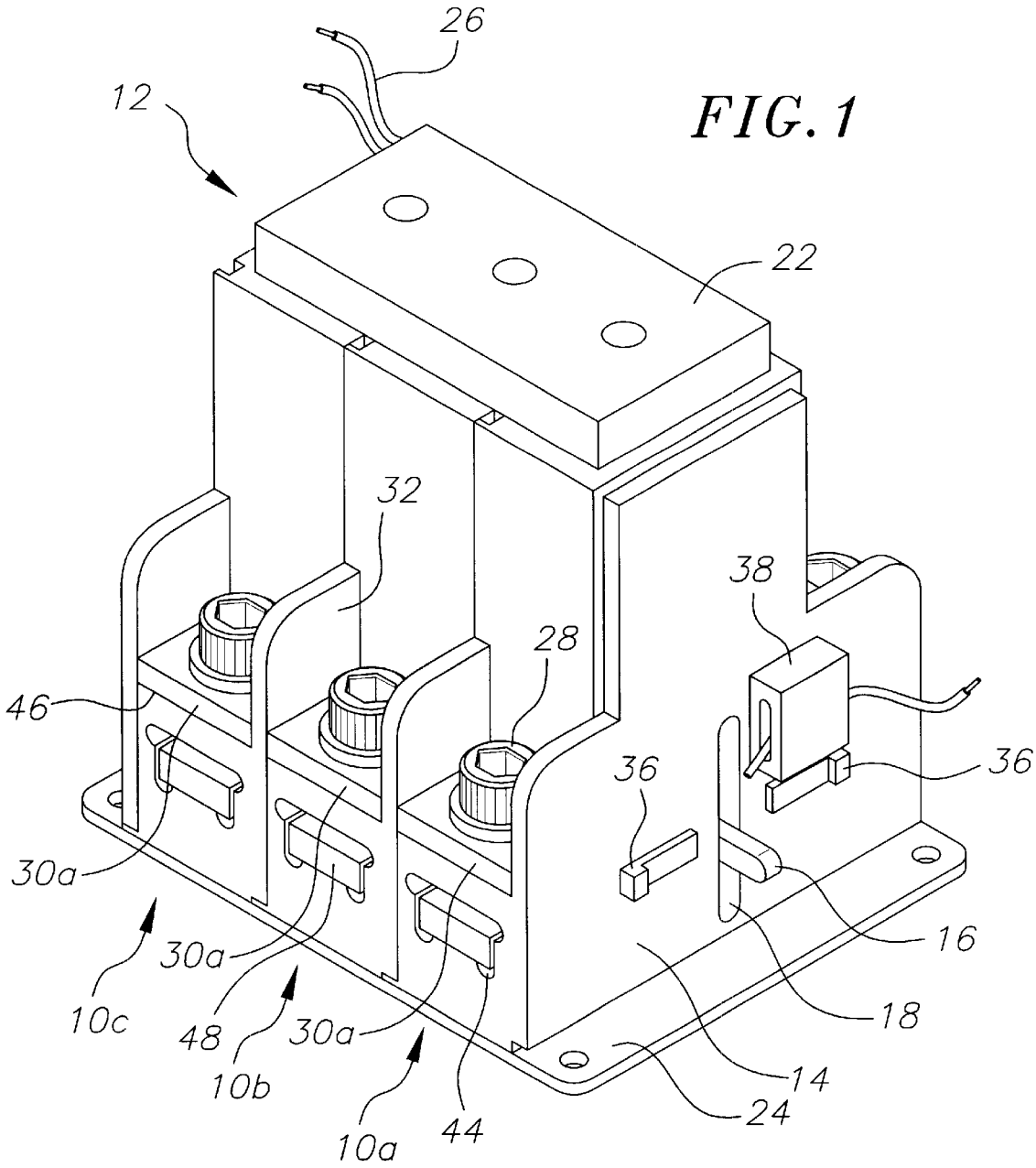
FIG. 1 is a front perspective view of three modular electrical relay contactor ganged together into a three-phase relay.

Referring to FIG. 1, there is shown a front perspective view of three modular electrical relay contactors 10*a*, 10*b*, and 10*c* ganged together into a three-phase relay unit 12. A front face 14 of relay contactor 10*a* is shown, and an engagement pin 16 is shown extending through pin slot 18 on front face 14 of housing 20. A coil lead cover 22 attached to the top of three modular electrical relay contactors 10*a*, 10*b*, and 10*c* and a support plate 24 is connected to the bottom of three modular electrical relay contactors 10*a*, 10*b*, and 10*c*. Coil leads 26 for each modular electrical relay contactors 10*a*, 10*b*, and 10*c* extend through coil lead cover 22. Terminal bolts 28 provide for power lead attachment to stationary contacts 30A. Terminal separator wall portions 32 are formed as part of rear face 14 of housing and provide a physical separation between adjacent terminals 28. Stationary contacts 30A pass through guide slots 34 in housing 20 (as best shown in FIGS. 2, 4, 5 and 7.) Alignment protrusions 36 are formed on front face 14, the function of which will be discussed further below. An optional engagement pin position sensor 38 can be provided to sense the position of engagement pin 16, and thus provide information as to whether three-phase relay contactor unit 12 is in its energized position or its unenergized position.

Figure 2:
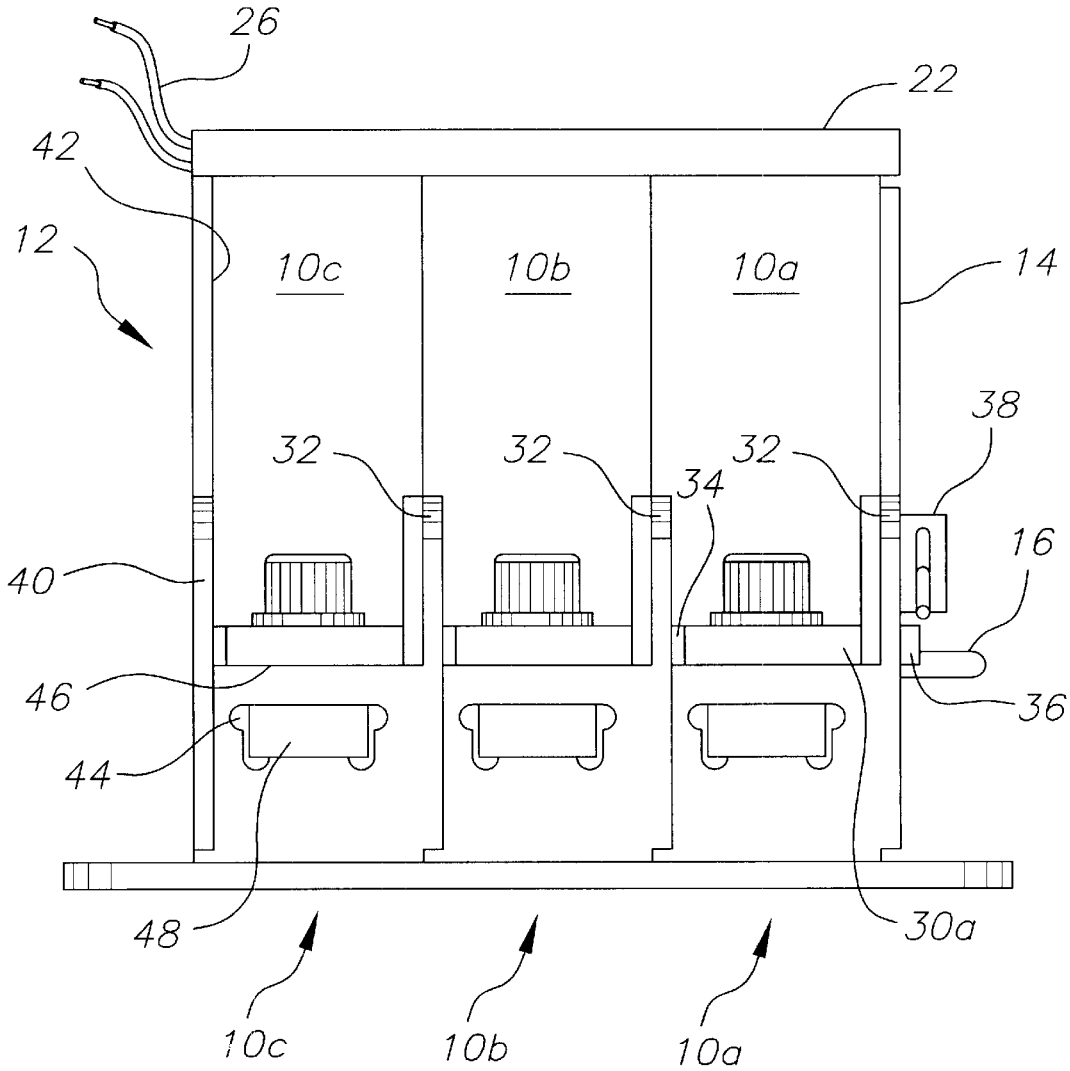
FIG. 2 is side view of the electrical relay contactor of FIG. 1.

Turning to FIG. 2, a left side view of three modular electrical relay contactors 10*a*, 10*b*, and 10*c* ganged together into a three-phase relay unit 12 shown in FIG. 1 is shown, and shows stationary contacts 30 slide through guide channel 34. Engagement pin 16 is shown extending through rear face 14 of housing 20 and optional engagement pin position sensor 38 is also shown attached to front face 14 of electrical relay contactor 10*a*. Alignment protrusions 36 are shown protruding rear face 14. A rear cover 40 is shown attached to a rear face 42 of housing 20 of modular electrical relay contactors 10*c*. In order to permit guide bolts 28 to attach to housing 20, a hollow 44 is formed in side of housing below a platform 46 upon which sits stationary contact 30A. A backing plate 48 with a threaded hole (not shown) is placed in hollow 44, and guide bolts 28 screw into backing plate 28.

Figure 3:
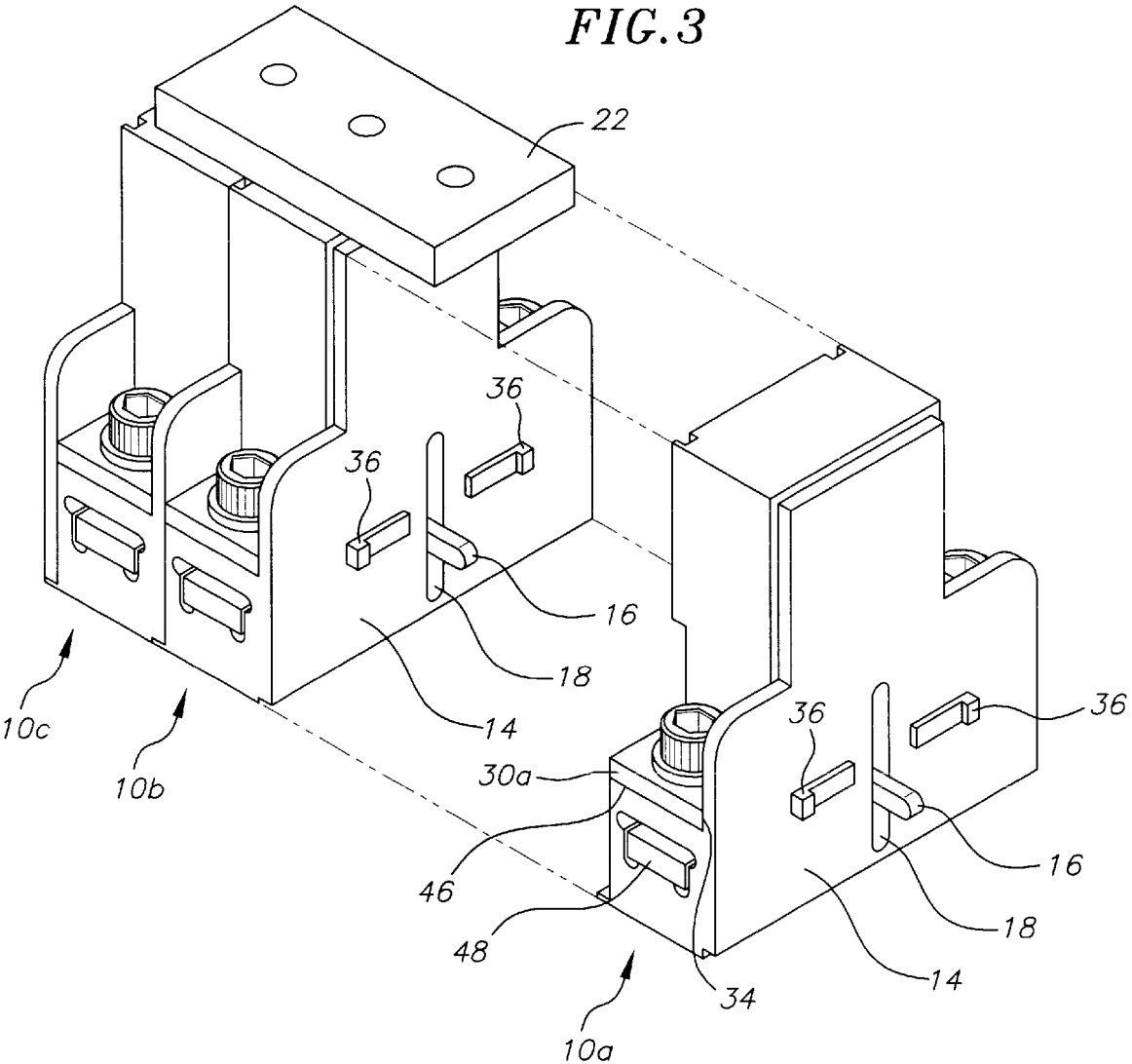
FIG. 3 is a exploded view of FIG. 1, with one modular relay separated from two other modular relay contactor units.

FIG. 3 is a exploded view showing electrical relay contactor 10*a* separated from electrical relay contactor 10*b* and 10*c* and coil lead cover 22. As can be seen, front face 14 and engagement pin 16 of electrical relay contactor 10*b* is identical to that of electrical relay contactor 10*a*.

Figure 4:
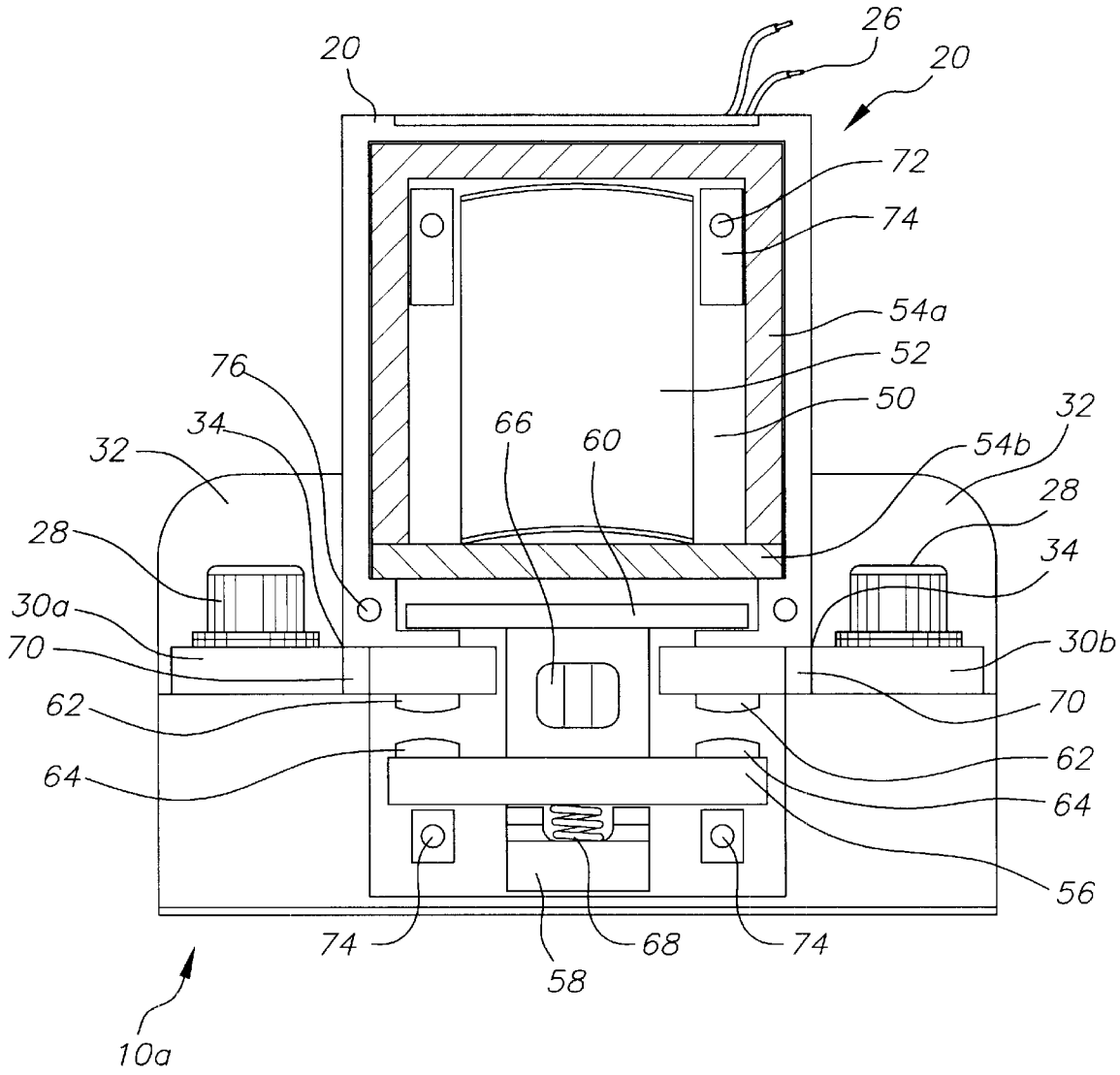
FIG. 4 is a rear view of a single modular electrical relay contactor.

Turning now to FIG. 4, there is shown a rear view of electrical relay contactor 10*a*. In an upper portion 50 of housing 20 of exposed electrical relay contactor 10*a*, an electromagnetic motor (comprising a magnetic coil 52 and a metallic outer core 54) are shown. Metallic outer core can comprise a single rectangular loop (not shown), or can comprise a U-shaped member with a flat member 54B, in tight contact to form a continuous metallic loop. Coil leads 26 extend through top of metallic outer core 54 and out of top of housing 20. Stationary contacts 30A and 30B are placed through guide slots 34 in housing, and are retained with terminal bolts 28. A moveable contactor 56 is carried by moveable contactor carrier 58. A metallic clapper plunger 60 is connected to top of moveable contactor carrier 58. Stationary contacts 30A and 30B have contact pads 62 on a lower surface thereof. Moveable contactor 56 has contact pads 64 on an upper surface thereof. Contact pads 62 and 64 are aligned so that when magnetic coil 52 is energized, a magnetic field is generated in metallic outer coil 54 which attracts metallic clapper plunger 60 upwardly. Since clapper plunger 60 is attached to moveable contactor carrier 58, this will raise up moveable contactor carrier 58 and moveable contact 56 so that contact pads 62 and 64 make contact, and a closed circuit will be established between stationary contacts 30A and 30B. An engagement pin aperture 66 is formed in moveable contactor carrier 58, and is sized to snugly receive the engagement pin of an adjacent electrical relay contactor. A biasing means, such as a spring 68, is preferably located in moveable contactor carrier 50 below moveable contact 56 to bias it upwardly within moveable contactor carrier 58 to permit some shock absorbency when pads 64 of moveable contact 56 touch pads 62 of stationary contacts 30A and 30B. Stationary contacts 30A and 30B preferably have notches 70 formed along their longitudinal sides. Alignment protrusions 36 of adjacent electrical relay contactor to be ganged thereto are sized to fit into notches 70, which further secure and stabilize stationary contacts 30A and 30B within housing 20. Standoffs 72 with attachment means (e.g. screw holes 74) and screw holes 76 are formed in housing 20 to permit attachment of rear cover 40 of the housing to close up the desired number of individual and ganged together electrical relay contactors. Housing 20 is made of a non-conductive material, such as nylon reinforced plastic. Moveable contact carrier 58 is also made of non-conductive material, such as plastic.

Figure 5:
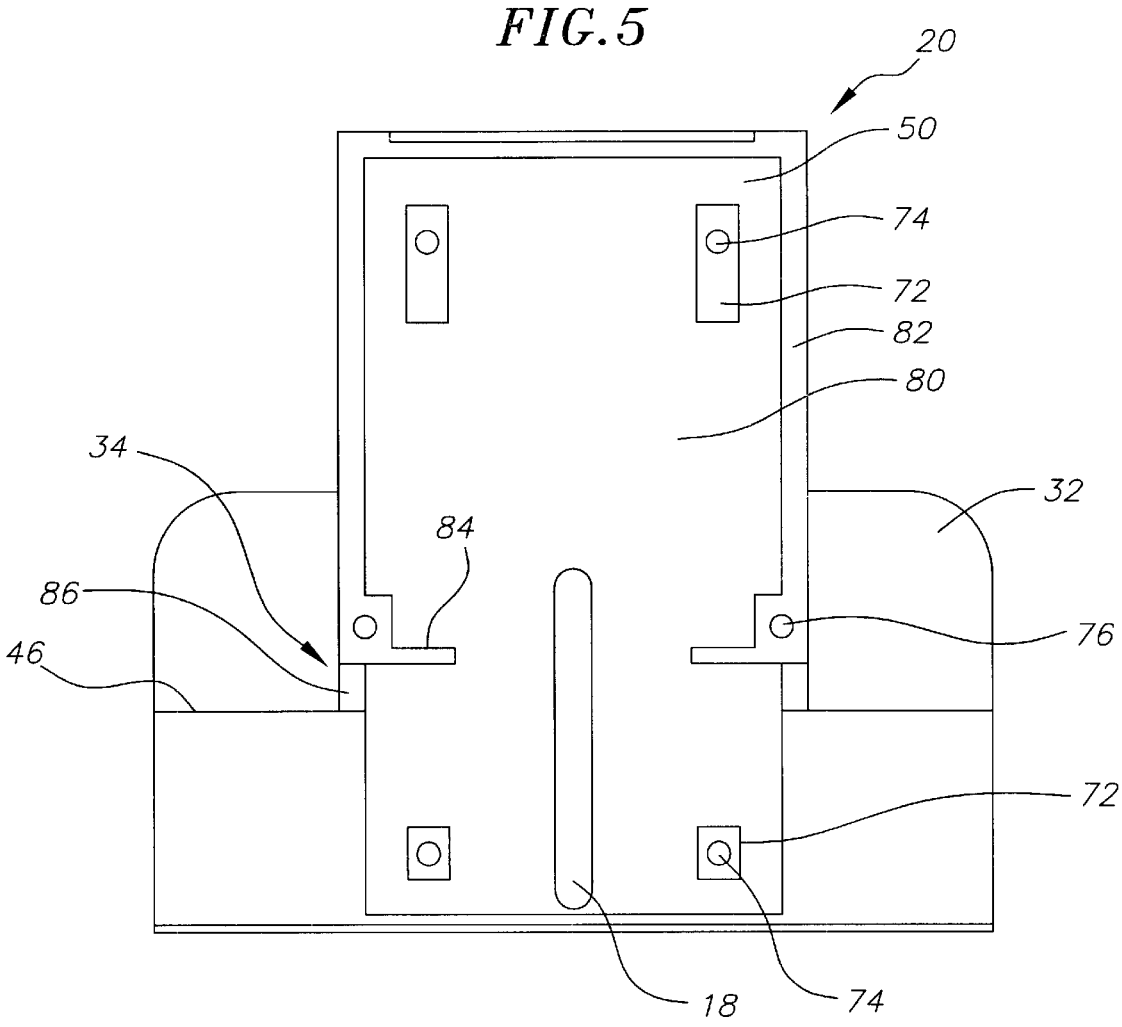
FIG. 5 is a rear view of the housing portion of the single modular electrical relay contactor shown in FIG. 4, but with the components removed.

Turning now to FIG. 5, there is shown a rear view of the housing 20 of the single modular electrical relay contactor 10*a* shown in FIG. 4, but with the components removed. Housing 20 has a wall 80 (the front surface of which is seen in FIGS. 1–3. Upper portion 50 has perimeter walls 82 at its sides and upper regions. At upper end of guide slot 34 a wall segment 84 helps retain upper surface of stationary contacts 30A and 30B, and prevent stationary contacts 30A and 30B from being pushed up when contacted by moveable contact 56 (as shown in FIG. 4). A protrusion 86 is formed in guide slot 86 and catches on a notch 70 on the side of stationary contact not shown in FIG. 4. Pin slot 18 is formed through wall 80.

Figure 6:
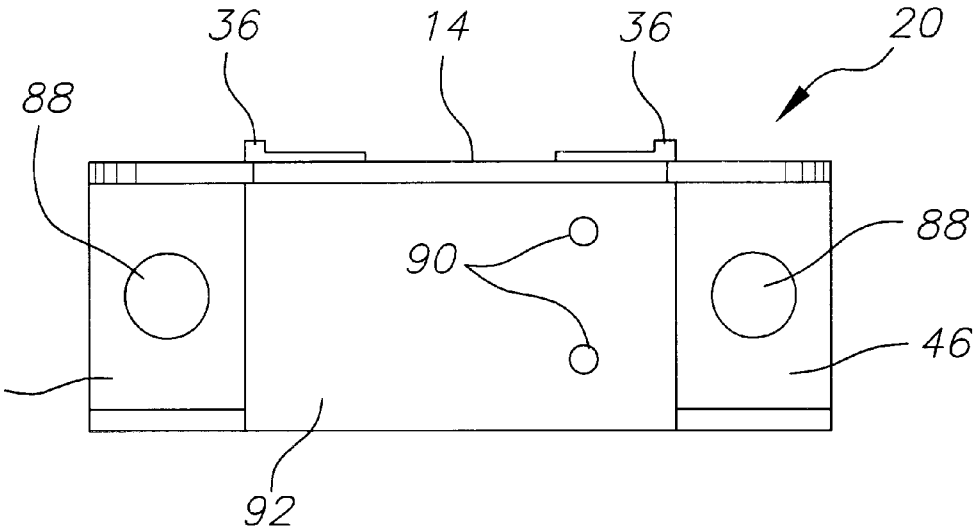
FIG. 6 is a top view of the housing portion of FIG. 5.

FIG. 6 is a top view of housing 20. Bolt apertures 88 are formed through platform 46 on both sides of housing 20. Screw holes 90 are formed in top 92 of housing, and are used for attaching to coil lead cover 22 (not shown).

Figure 7:
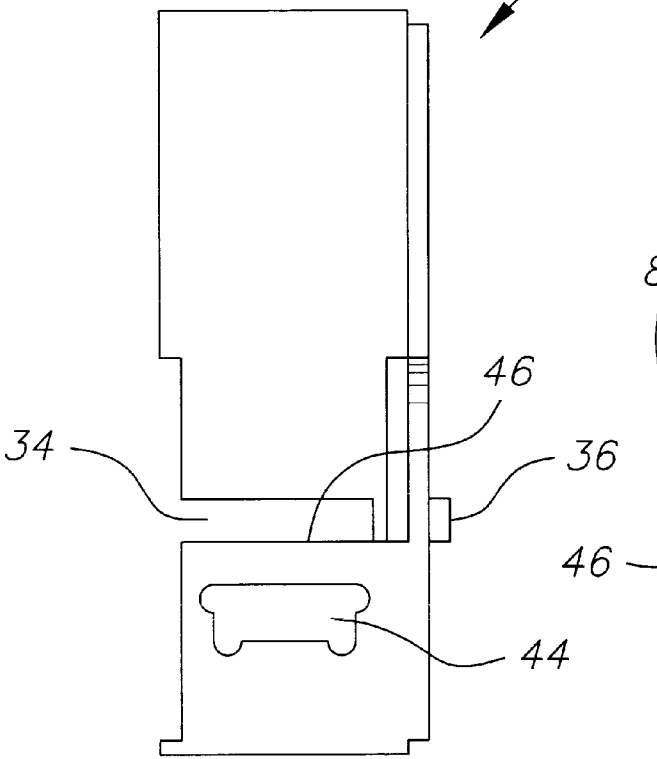
FIG. 7 is a right side view of the housing portion of FIG. 5.

FIG. 7 is a side view of housing 20. Guide slot 34, hollow 44, platform 46, and protrusion 36 are shown.

Figure 8:
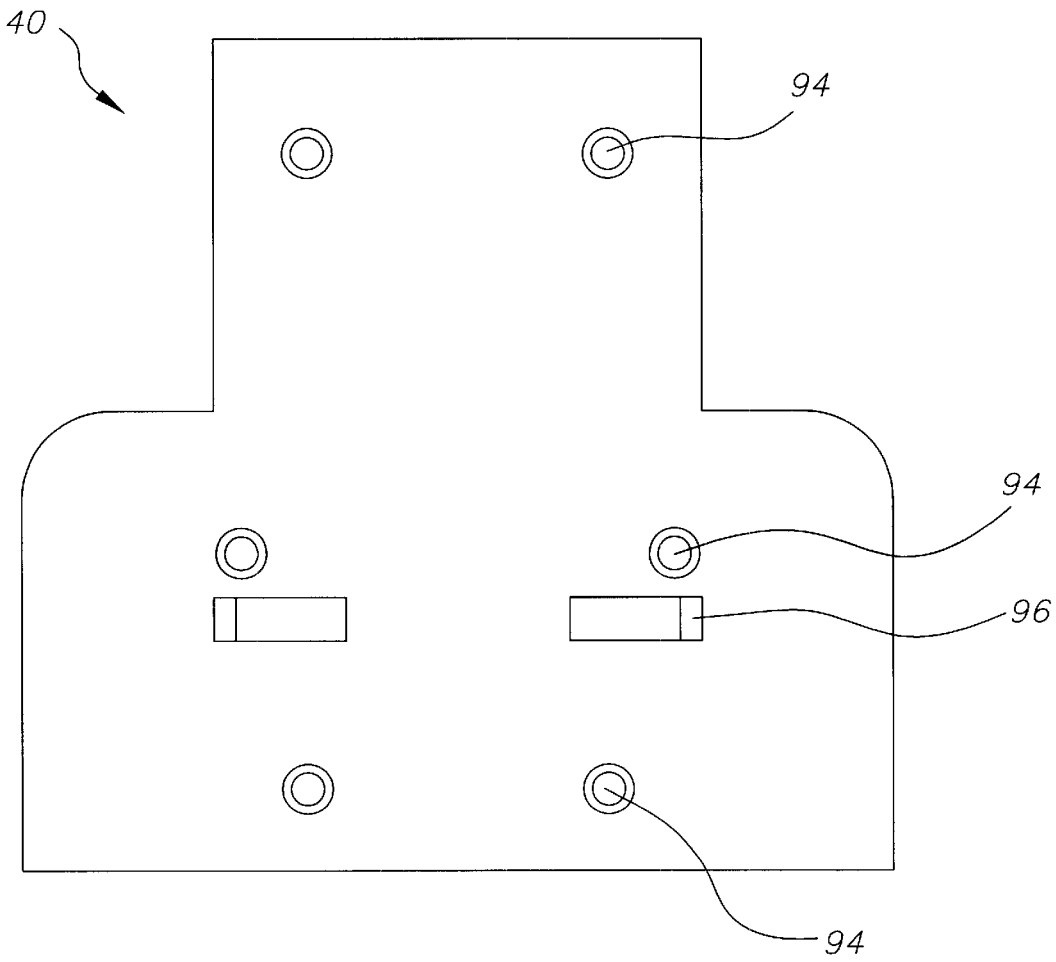
FIG. 8 is a back view of the rear cover of the housing portion of FIG. 2.

Turning now to FIG. 8, a rear view of rear cover 40 of housing 20 is shown. Screw holes 94 are formed through rear cover in alignment with screw holes 74 and 76 (as shown in FIGS. 4 and 5). Protrusions 96 extend from rear cover 40, and have the same pattern as protrusions 36 on front face 14 of housing. Rear cover 40, when screwed to open rear face 42 of electrical relay contactor 10*c*, will further lock in stationary contacts 30A and 30B (not shown.)

Figure 9:
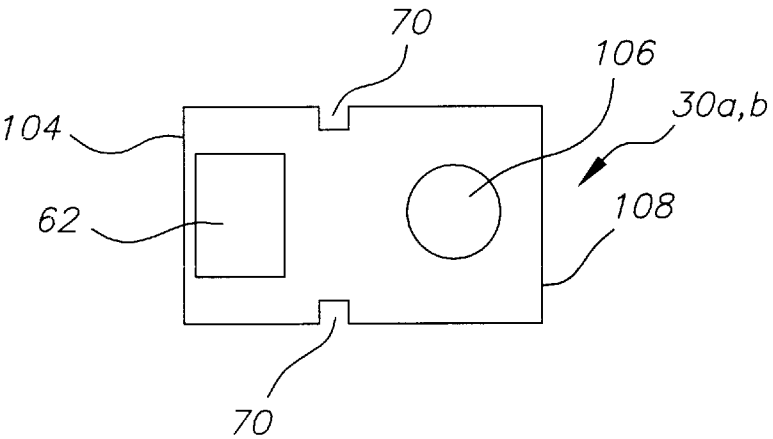
FIG. 9 is a top view of a stationary contact of the single modular electrical relay contactor shown in FIG. 4.
Figure 10:
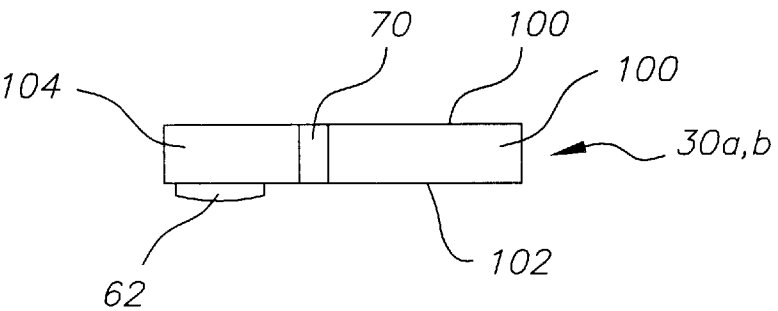
FIG. 10 is a side view of the stationary contact FIG. 9.

FIGS. 9 and 10 are views of stationary contacts 30A and 30B, which are identical. Stationary contacts 30A and 30B have a top side 100 and a bottom side 102 . Contact pad 62 is affixed to bottom side 102 of a first end 104 of stationary contacts 30A and 30B. A terminal bolt hole 106 is formed at a second end of stationary contacts 30A and 30B.

Figure 11:
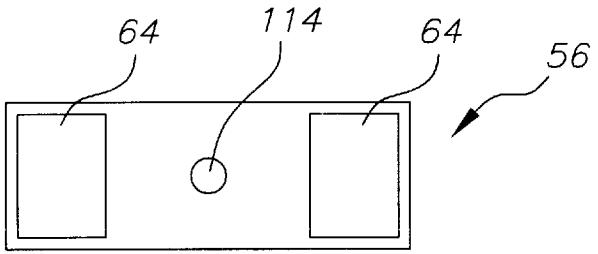
FIG. 11 is a top view of a movable contact of the single modular electrical relay contactor shown in FIG. 4.
Figure 12:
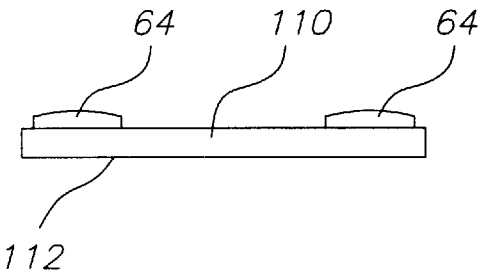
FIG. 12 is a side view of the movable contact in FIG. 11.

FIGS. 11 and 12 are views of moveable contact 56. Moveable contact 56 has an upper surface 110 and a lower surface 112. A guide pin aperture 114 is formed in the center of moveable contact 56 midway between the two contact pads 64 on upper surface 110. FIG. 13 is a top view of clapper plunger 60. It has apertures 120 formed therethrough so that clapper plunger 60 can be affixed to moveable contactor carrier 58 (as best shown in FIG. 4.)

FIG. 14 is a side view of a guide pin 122. Guide pin 122 has an elongate and smooth slide shank 124 and a head 126 with exterior thread 128 and turning means (such as by being provided with a turning slot 130.) For durability and reliability of operation, guide pin 122 can be formed of material such as stainless steel.

FIGS. 15–17 are various views of the moveable contactor carrier 58. Moveable contactor carrier 58 has a top 136 with screw holes 138 for attachment with screws to clapper plunger 60. A channel 140 is formed in moveable contactor carrier 58 and is sized to receive moveable contact 56. A spring receiving cavity 142 is formed in moveable contactor carrier 58 below channel 140, and is adapted to receive biasing means 68 (as shown in FIG. 4.) An aperture 144 is formed through top 136, and has a female threaded upper portion 146 which is sized to engage with exterior thread 128 of head 126 of guide pin 122. As can be seen, engagement pin 16 extends from a front side 148 which is in horizontal alignment with engagement pin aperture 66, which is formed through a rear side 150.

Figure 18:
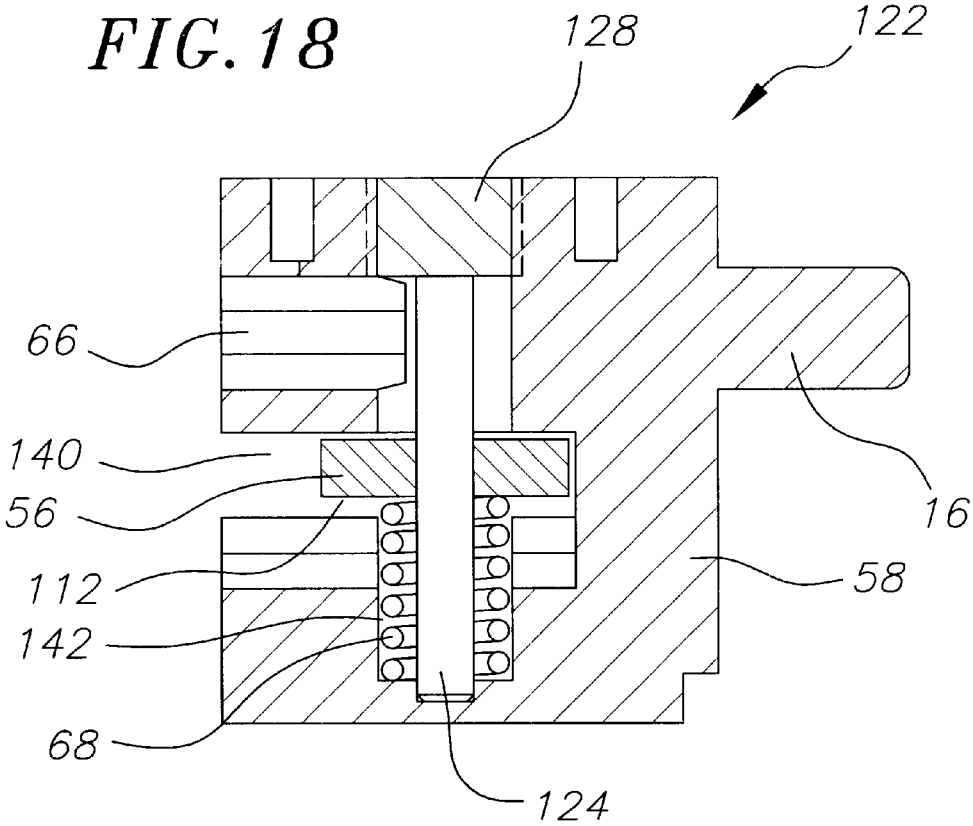
FIG. 18 is a cross-section side view of the moveable contact carrier of the single modular electrical relay contactor shown in FIG. 4, shown with its carried moveable contact.
Figure 19:
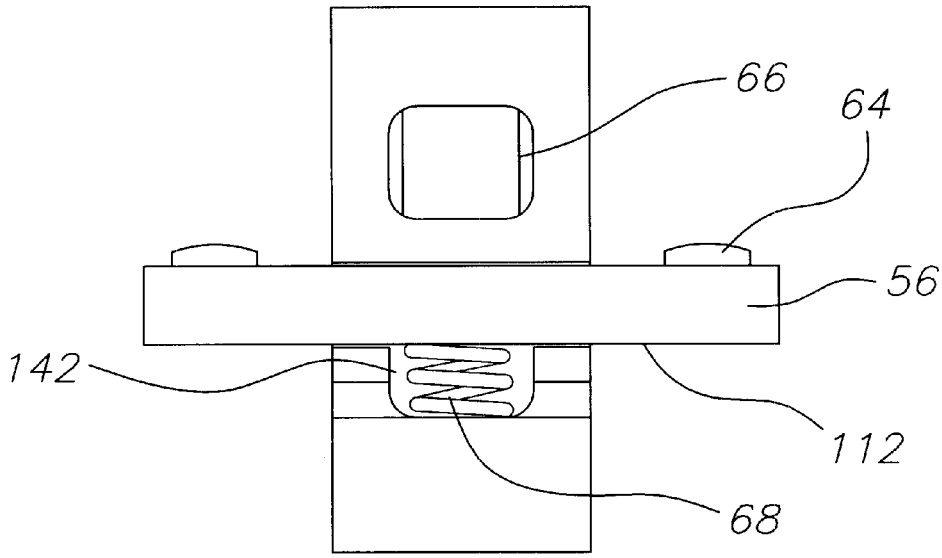
FIG. 19 is a front view of the moveable contact carrier, shown with its carried moveable contact.

Turning to FIGS. 18 and 19, there are shown details of moveable contact carrier 68 with its moveable contact 56, guide pin 122, and optional spring 68. The optional spring 68 will bias upwardly on bottom 112 of moveable contact 56 and provide some "give" so that moveable contact 56 can better seat with stationary contacts 30A and 30B.

As noted above, the herein described modular multi-phase contactor 12, by nature of its modular elements, allows for flexible manufacturing, reduced tooling and inventor costs, as a module for each phase of the desired number of phased contactor can be easily assembled from common elements. For example, if a contactor for switching two phases is all that is needed, then two electrical relay contactors are needed. If a three phase electrical relay contactor is need, then three units will be used. Furthermore, this design provides for greater reliability since that if one or more of the magnetic coils of the individual electrical relay contactors fails, then the other magnetic coils can provide enough force to move the moveable contactor 56. Furthermore, the contactor as shown is a single pole, double throw relay. However, the design could be adapted to single pole, single throw type relay contactors (e.g. by having a one stationary contact pivotally connected to the moveable contact.)

The above noted design provides for simplicity of design, uses relatively few parts, increases reliability, and decreases assembly time.

What is claimed is:

1. A modular, multi-phase electrical relay contactor, comprising a plurality of electrical relay contactor units, each comprising:

a housing;

an electromagnetic motor located within the housing;

a stationary contact with contact pads on underside surfaces thereof;

a moveable contact with contact pads on upper surfaces thereof that are in alignment with the contact pads on the stationary contacts; and a moveable contact carrier engaged with the moveable contact, the moveable contact carrier having metallic means attractable by the electromagnetic motor, and having a protrusion extending from a frontwardly facing front side thereof and an aperture formed through a rearwardly facing rear side thereof that is sized to receive the protrusion of a rearwardly positioned electrical relay contactor unit;

wherein a plurality of electrical relay contactor units can be connected together such that the protrusion extending from the moveable contact carrier of a forwardly located electrical relay contactor unit will fit into the aperture formed in the moveable contact carrier of a rearwardly located electrical relay contactor unit, thereby providing synchronous movement of the plurality of moveable contact carriers and the moveable contacts.

2. The modular, multi-phase electrical relay contactor of claim 1, wherein the metallic means comprises a metallic clapper plunger attached to the moveable contact carrier.

3. The modular, multi-phase electrical relay contactor of claim 1, wherein each housing has a forwardly facing front face with a slot formed therein and a rearwardly facing open back, the front face of a rearwardly located electrical relay contactor unit being engageable with the open back of a rearwardly located electrical relay contactor unit.

4. The modular, multi-phase electrical relay contactor of claim 3, further comprising a rear cover to cover the open back of a rearmost located electrical relay contactor unit.

5. The modular, multi-phase electrical relay contactor of claim 4, wherein the stationary contacts have notches formed therein, the notches being sized to fit with complementary protrusions formed on an inside surface of the front face housing, complementary protrusions formed on an outside surface of the front face of the housing, and on the rear cover.

6. The modular, multi-phase electrical relay contactor of claim 1, further comprising plates for securing together a plurality of electrical relay contactor units.

7. The modular, multi-phase electrical relay contactor of claim 1, wherein the electromagnetic motor comprises a magnetic coil and a metallic outer core located in an upper portion of the housing.

8. The modular, multi-phase electrical relay contactor of claim 1, wherein a pair of stationary contacts are affixed to the housing by terminal bolts.

9. The modular, multi-phase electrical relay contactor of claim 1, wherein the moveable contact carrier has a channel formed therein in which the moveable contact is carried.

10. The modular, multi-phase electrical relay contactor of claim 9, further comprising a guide pin which fits into the moveable contact carrier and an aperture in the moveable contact to permit the moveable contact to move up and down within the moveable contact carrier.

11. The modular, multi-phase electrical relay contactor of claim 10, further comprising a biasing spring placed within the moveable contact carrier for providing an upwardly biasing force on the underside of the moveable contact.

12. A modular, multi-phase electrical relay contactor, comprising a plurality of electrical relay contactor units, each comprising:

a housing with a front face with an aperture formed therein and an open back;

an electromagnetic motor comprising a magnetic coil and a metallic outer core located in an upper portion of the housing;

a pair of stationary contacts with contact pads on underside surfaces thereof;

a moveable contact with contact pads on upper surfaces thereof that are in alignment with the contact pads on the stationary contacts;

a metallic clapper plunger; and a moveable contact carrier engaged with the moveable contact, the metallic clapper plunger being affixed to a top of the moveable contact carrier, the moveable contact carrier having a protrusion extending from a forwardly facing front side thereof and an aperture formed through a rearwardly facing rear side thereof that is sized to receive the protrusion of another electrical relay contactor unit, the protrusion moveably extending through the aperture in the front face of the housing;

wherein a plurality of electrical relay contactor units can be connected together with the front face of a rearwardly positioned electrical relay contactor unit placed adjacent to the open back of a frontwardly positioned electrical relay contactor unit such that the protrusion extending from the front side of the moveable contact carrier of the forwardly located electrical relay contactor unit will fit into the aperture formed in the rear side of the moveable contact carrier of the rearwardly located electrical relay contactor unit, thereby providing synchronous movement of the plurality of moveable contact carriers and the moveable contacts when the electromagnetic motor is activated.

13. The modular, multi-phase electrical relay contactor of claim 12, wherein the moveable contact carrier has a channel formed therein in which the moveable contact is carried.

14. The modular, multi-phase electrical relay contactor of claim 13, further comprising a guide pin which fits into the moveable contact carrier and an aperture in the moveable contact to permit the moveable contact to move up and down within the moveable contact carrier.

15. The modular, multi-phase electrical relay contactor of claim 14, further comprising a biasing spring placed within the moveable contact carrier and provided to bias upwardly the underside of the moveable contact.

16. The modular, multi-phase electrical relay contactor of claim 12, further comprising a rear cover to cover the open back of a rearmost located electrical relay contactor unit.

17. The modular, multi-phase electrical relay contactor of claim 16, wherein the stationary contacts have notches formed therein, the notches being size to fit with complementary protrusions formed on an inside surface of the front face housing, complementary protrusions formed on an outside surface of the front face the housing, and on the rear cover.

18. A modular, multi-phase electrical single pole, double throw relay contactor, comprising a plurality of single pole, double throw relay electrical relay contactor units, each comprising:

a housing;

an electromagnetic motor located within the housing;

a pair of stationary contacts with contact pads formed on underside surfaces thereon;

a moveable contact with contact pads formed on an upper surfaces thereon; and a moveable contact carrier engaged with the moveable contact and carrying the moveable contact in a position parallel to the stationary contacts, the moveable contact carrier having metallic means attractable by the electromagnetic motor, and having a protrusion extending from a forwardly facing side thereof and an aperture formed through a rearwardly facing side thereof, the aperture being sized to receive the protrusion of another electrical relay contactor unit;

wherein a plurality of electrical relay contactor units can be connected together such that the protrusion extending from the moveable contact carrier of a forwardly located electrical relay contactor unit will fit into the aperture formed in the moveable contact carrier of a rearwardly located electrical relay contactor unit, thereby providing synchronous movement of the plurality of moveable contact carriers and the moveable contacts.

* * * * *